US008137808B2

(12) United States Patent
Musch

(10) Patent No.: US 8,137,808 B2
(45) Date of Patent: Mar. 20, 2012

(54) FILING MATERIAL AND A METHOD AND A DEVICE FOR MANUFACTURING IT

(75) Inventor: Jurgen Musch, Welver (DE)

(73) Assignee: Carl Freudenberg AG, Weinheim (DE)

( * ) Notice: Subject to any disclaimer, the term of this patent is extended or adjusted under 35 U.S.C. 154(b) by 1478 days.

(21) Appl. No.: 11/631,309

(22) PCT Filed: Jun. 20, 2005

(86) PCT No.: PCT/EP2005/006648
§ 371 (c)(1),
(2), (4) Date: Jan. 3, 2007

(87) PCT Pub. No.: WO2006/002797
PCT Pub. Date: Jan. 12, 2006

(65) Prior Publication Data

US 2008/0305296 A1 Dec. 11, 2008

(30) Foreign Application Priority Data

Jul. 3, 2004 (EP) ..... 04015694

(51) Int. Cl.
*D02G 3/00* (2006.01)
*B32B 3/26* (2006.01)
*D04H 1/00* (2006.01)

(52) U.S. Cl. ..... 428/361; 428/403; 428/913; 428/372; 428/407; 442/327

(58) Field of Classification Search ..... 156/62.4; 428/113, 323, 361, 321, 372, 913; 52/309.16
See application file for complete search history.

(56) References Cited

U.S. PATENT DOCUMENTS

| | | | | |
|---|---|---|---|---|
| 4,167,604 | A * | 9/1979 | Aldrich | 428/359 |
| 4,280,538 | A * | 7/1981 | Hazelbaker | 141/73 |
| 4,618,531 | A | 10/1986 | Marcus | |
| 5,366,801 | A | 11/1994 | Bryant et al. | |
| 5,885,475 | A * | 3/1999 | Salyer | 252/70 |
| 6,217,993 | B1 | 4/2001 | Pause | |
| 6,464,672 | B1 | 10/2002 | Buckley | |
| 6,492,020 | B1 * | 12/2002 | Ahn et al. | 428/359 |
| 6,517,648 | B1 * | 2/2003 | Bouchette et al. | 156/62.4 |
| 7,043,786 | B1 * | 5/2006 | Hall et al. | 5/636 |
| 2003/0087058 | A1 | 5/2003 | Bouchette et al. | |
| 2005/0151287 | A1 * | 7/2005 | Bouchette et al. | 264/14 |
| 2005/0281979 | A1 * | 12/2005 | Toas et al. | 428/113 |

FOREIGN PATENT DOCUMENTS

EP 0 306 202 A2 3/1989

(Continued)

*Primary Examiner* — Jennifer Chriss
*Assistant Examiner* — Ricardo E Lopez
(74) *Attorney, Agent, or Firm* — Birch, Stewart, Kolasch & Birch, LLP

(57) ABSTRACT

A filling material for filling into articles of bedding is made by
providing a plurality of discrete fiber clusters,
applying a temperature stabilizing substance to the discrete fiber clusters,
mixing the discrete fiber clusters with each other, and
collecting the discrete fiber clusters thereby obtaining a filling material in which the distribution of the temperature stabilizing substance is substantially even.

A device (1) for producing a filling material has an application station (22) for applying a temperature stabilizing substance to discrete fiber clusters, a curing station (24) for fixing the substance, a mixer (30) for mixing the discrete fiber clusters and a collecting station (32) for collecting the fiber clusters to form the filling material in which the distribution of the temperature stabilizing substance is substantially even.

6 Claims, 7 Drawing Sheets

FOREIGN PATENT DOCUMENTS

| | | | |
|---|---|---|---|
| EP | 0 203 469 | B1 | 1/1993 |
| EP | 0 611 330 | B1 | 1/1998 |
| EP | 0 932 717 | B1 | 4/2001 |
| WO | WO-98/12366 | A1 | 3/1998 |
| WO | WO-99/25549 | A1 | 5/1999 |
| WO | WO-99/41067 | A1 | 8/1999 |
| WO | WO-02/12607 | A2 | 2/2002 |
| WO | WO-02/24789 | A2 | 3/2002 |
| WO | WO-02/24830 | A2 | 3/2002 |
| WO | WO-02/24992 | A1 | 3/2002 |
| WO | WO-03/027365 | A1 | 4/2003 |
| WO | WO-03/059614 | A1 | 7/2003 |
| WO | WO-03/062513 | A2 | 7/2003 |

* cited by examiner

FILING MATERIAL AND A METHOD AND A DEVICE FOR MANUFACTURING IT

TECHNICAL FIELD OF THE INVENTION

The present invention relates to a method of producing a filling material for filling into articles of bedding, garments and the like.

The present invention further relates to a filling material for filling into articles of bedding, garments and the like.

The present invention also relates to a device for manufacturing a filling material for filling into articles of bedding, garments and the like.

BACKGROUND ART

Fibre filling materials are used for filling into articles of bedding, such as pillows, sleeping bags and quilts, to provide a comfortable feeling and isolation. It would be desirable to provide a filling material that would give the pillow or quilt a temperature regulating effect, which could mean a cool feeling during a longer period than what is possible with the existing filling materials or, as alternative, could mean a heating of a human body.

EP 0 611 330 B1 describes a mixture of polyurethane and microcapsules containing a phase change material. The mixture is sprayed onto a nonwoven fabric substrate, such as Hollofil®, manufactured by E.I. Du Pont de Nemours Company, to form a coating. The phase change material, functioning as a temperature stabilizing means, provides a temperature stabilizing effect for the nonwoven fabric substrate. When heated, e.g. by a human body, the phase change material undergoes a phase change, e.g. a transition from solid state to liquid state, under absorption of heat, thereby reducing the temperature increase in the non woven fabric substrate. As alternative the non woven fabric substrate could be pre-heated such that a phase change material is in liquid state and thus provide an initial heating of a human body as the phase change material undergoes a change from liquid state to solid state. The coated nonwoven fabric substrate made in accordance with EP 0 611 330 B1 is intended for the use as a thermal barrier in clothing, such as in gloves, but has, however, a rather harsh feeling to the skin, a reduced volume and refluffability and is not suitable for filling into articles of bedding, garments and the like, in which softness and refluffability is of importance.

SUMMARY OF THE INVENTION

A purpose of the present invention is to provide an efficient method of forming a filling material suitable for filling into pillows, quilts, mattresses, mattress pads, garments, such as jackets, and other textiles that might come into contact with the human skin and therefore should have a soft feeling.

This object is achieved by a method according to the preamble and characterized by the steps of providing a plurality of discrete fibre clusters, applying a temperature stabilizing substance to the discrete fibre clusters in such a way that at least some of the discrete fibre clusters obtain an uneven distribution of the temperature stabilizing substance throughout the individual fibre cluster, mixing the discrete fibre clusters with each other, and collecting the discrete fibre clusters thereby obtaining a filling material in which the distribution of the temperature stabilizing substance is substantially even.

An advantage of this method is that it provides an even distribution of the temperature stabilizing substance in the filling material. This provides for a prolonged heat buffering effect of the temperature stabilizing substance. Another advantage of this method is that the filling material produced is very soft, has good refluffability and is suitable for use in filling into pillows, quilts and similar articles of bedding. Since the individual fibre cluster has an uneven distribution of the temperature stabilizing substance it will retain most of its softness and refluffability, in particular in regions of the individual fibre cluster with no or little temperature stabilizing substance. In those regions the fibres of the individual fibre cluster are not fixed to each other at crossing points and thus the refluffability is not negatively affected.

Preferably the temperature stabilizing substance is applied in the form of microcapsules containing a phase change material or plastic crystals. The microcapsules keeps the phase change material or the plastic crystals in place such that it does not contaminate the article in which the filling material is applied.

According to a preferred embodiment the step of applying a temperature stabilizing substance to the discrete fibre clusters comprises forming a mixture of the temperature stabilizing substance and a binder, applying the mixture of the temperature stabilizing substance and the binder to the discrete fibre clusters, and curing the binder to firmly attach the temperature stabilizing substance to the discrete fibre clusters. An advantage with this embodiment is that the temperature stabilizing substance is not easily removed from the fibre clusters. Thus the filling material could better withstand handling, use and washing without the loss of temperature stabilizing substance.

According to another preferred embodiment the step of applying a temperature stabilizing substance to the discrete fibre clusters comprises forming a mixture of the temperature stabilizing substance and a solvent, applying the mixture of the temperature stabilizing substance and the solvent to the discrete fibre clusters, evaporating the solvent, applying a binder to the discrete fibre clusters, and curing the binder to firmly attach the temperature stabilizing substance to the discrete fibre clusters. An advantage with this embodiment is that the distribution of the temperature stabilizing substance over the fibre clusters becomes more even. Thus the risk that some fibre clusters would obtain an unreasonably high amount of temperature stabilizing substance whereas most fibre clusters would get none is decreased.

According to a preferred embodiment the step of applying a temperature stabilizing substance to the discrete fibre clusters comprises providing a layer of a plurality of discrete fibre clusters on a belt, moving the discrete fibre clusters on the belt into a spraying zone in which the temperature stabilizing substance is sprayed onto the layer of discrete fibre clusters. An advantage with this embodiment is that it provides for efficient continuous manufacturing of filling material. The spray application makes it easy to control the amount of temperature stabilizing substance applied and thus provides for constant and predictable properties of the filling material produced. According to a still more preferred embodiment the layer of fibre clusters on the belt has an average thickness corresponding to 1-6 fibre clusters, even more preferably about 2-4 fibre clusters. Such a thickness causes a suitable portion of the fibre clusters to be provided with a temperature stabilizing substance.

According to another preferred embodiment the step of applying a temperature stabilizing substance to the discrete fibre clusters comprises forcing a plurality of discrete fibre clusters into a bath containing the temperature stabilizing substance and a solvent, and subsequently drying the fibre clusters to remove any solvent. The method according to this embodiment provides for providing all or almost all of the individual fibre clusters with an unevenly distributed amount of temperature stabilizing substance. This is advantageous in particular in cases where a filling material containing large amounts of temperature stabilizing substances is to be prepared.

Preferably the step of mixing the discrete fibre clusters with each other comprises exposing the discrete fibre clusters to a turbulent gas stream. A turbulent gas stream, which could be obtained with a fan, an ejector or other type of turbulence generating apparatus, has the advantage of providing a very good mixing of the discrete fibre clusters without exposing them to excessive wear. In addition the turbulent gas stream, e.g. an air stream, is very efficient in separating the fibre clusters from each other and to remove any excess temperature stabilizing substance from them.

Another object of the present invention is to provide a filling material which avoids the drawbacks of the prior art filling materials and thus to provide a filling material which is suitable for filling into pillows, quilts, mattresses, mattress pads, garments, such as jackets, and other textiles that come into contact with the human skin.

This object is achieved by a filling material according to the preamble and characterized in that the filling material comprises a plurality of discrete fibre clusters, at least some of which have attached thereto, with an uneven distribution throughout the individual fibre cluster, a temperature stabilizing substance, and in that the discrete fibre clusters of the filling material are mixed with each other providing a substantially even distribution of the temperature stabilizing substance in the filling material. An advantage with this filling material is that it provides for a prolonged temperature stabilizing effect due to the fact that the temperature stabilizing substance is evenly distributed throughout the filling material. Another advantage is that the filling material provides for a soft feeling which is particularly advantageous in applications were the filling material is filled into articles of bedding, such as pillows and quilts, that come in contact with the human skin.

According to a preferred embodiment the discrete fibre clusters are fibre balls. Fibre balls having a temperature stabilizing substance applied thereto have proven particularly suitable for forming a soft filling material with refluffable characteristics.

Preferably the discrete fibre clusters have an average characteristic measure, such as an average diameter, of 1-15 mm. An advantage with these sizes of fibre clusters is that they provide a particularly soft filling material.

According to one preferred embodiment the temperature stabilizing substance is bonded to the fibre clusters by a binder that is chosen from the group of siliconizing agents, that are often used as slickeners. Siliconizing agents, also known as silicone slickeners, which include polysiloxanes, amino silicones, silicone rubber and other silicone based agents suitable for slickening fibres, have, surprisingly, proven to provide a stable binding of the temperature stabilizing substance to the fibre clusters. In addition the siliconizing agent increases the softness and refluffability of the fibre clusters.

Preferably the amount of temperature stabilizing substance and a possible binder in the filling material corresponds to maximum 10% of the weight that the temperature stabilizing substance and the possible binder would have if they were to fill the same volume as is totally enclosed by the total number of individual discrete fibre clusters of the filling material. The fact that the fibre clusters are only partially filled with temperature stabilizing substance and possible binder makes them retain their softness and refluffability.

Another object of the invention is to provide a device suitable for the efficient manufacturing of a filling material suitable for filling into pillows, quilts, mattresses, mattress pads, garments, such as jackets, and other textiles that come into contact with the human skin.

This object is achieved by a device according to the preamble and characterized in that the device comprises an application station arranged to apply a temperature stabilizing substance onto a plurality of discrete fibre clusters, a curing station arranged to fix the temperature stabilizing substance to the plurality of fibre clusters, a mixer located downstream of the curing station and arranged to mix the discrete fibre clusters with each other, and a collecting apparatus arranged to collect the mixed fibre clusters to produce the filling material. An advantage of this device is that it provides for low cost continuous manufacturing of a high quality filling material having a temperature stabilizing substance dispersed therein.

These and other objects of the invention will be further described and elucidated in the following description and the appended claims.

BRIEF DESCRIPTION OF THE DRAWINGS

The invention will now be described in more detail with reference to the appended drawings.

DETAILED DESCRIPTION OF PREFERRED EMBODIMENTS OF THE INVENTION

Figure 1:
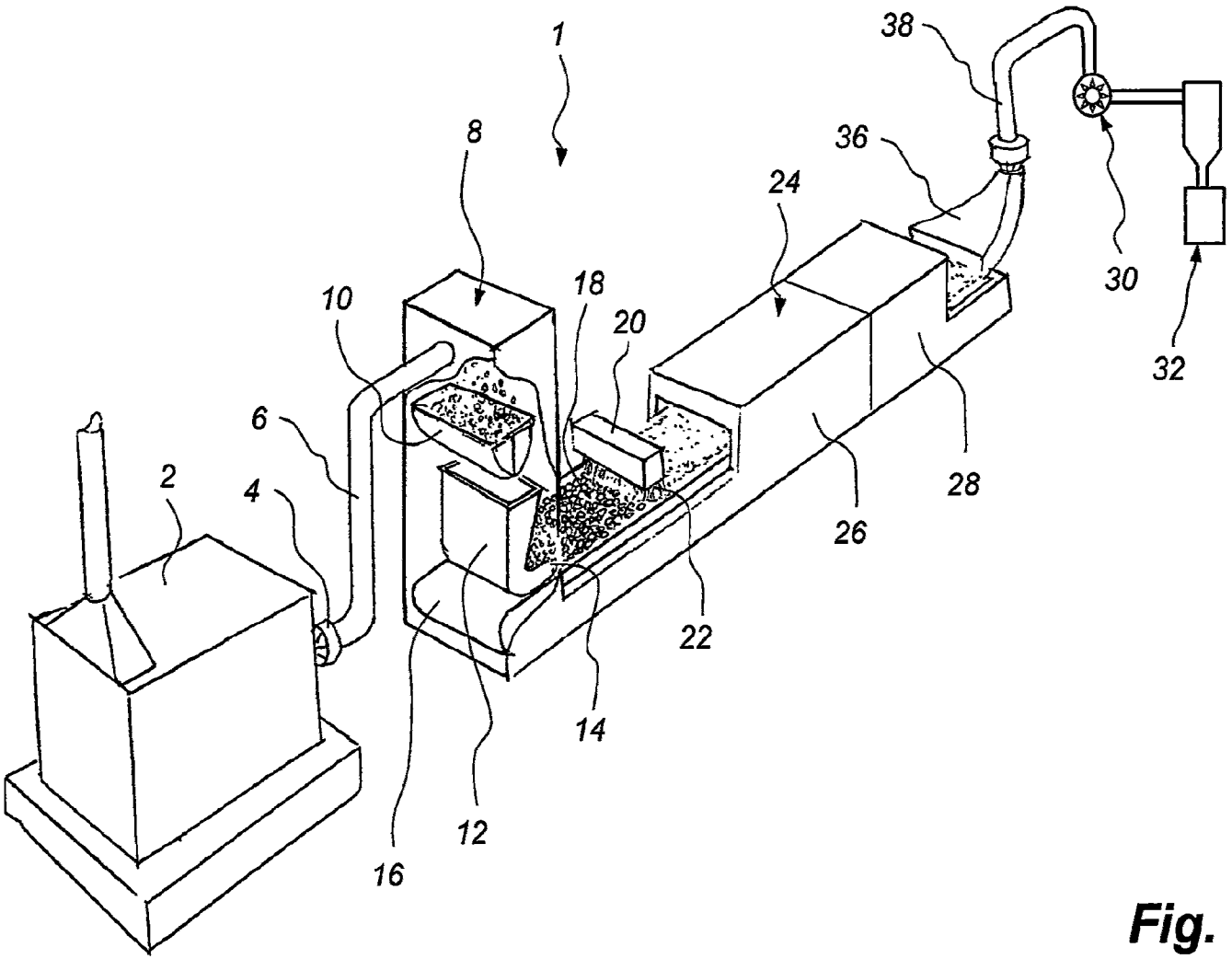
FIG. 1 is a perspective view and shows a first embodiment of the invention.

According to the invention a fibre filling material is made by applying a temperature stabilizing substance to a plurality of discrete fibre clusters. The discrete fibre clusters are then mixed. After the mixing the discrete fibre clusters are collected to form a filling material.

Discrete fibre clusters are fibre clusters that can be gathered to form a filling material. In the filling material the fibre clusters substantially retain their discrete characteristics and may thus be individually isolated, having substantially their original shape and size, from the filling material again if so would be desired. EP 0 203 469 B1 describes one example of fibre clusters in the form of refluffable fibre balls that are made from siliconized staple fibres that are entangled. The fibre balls according to that document are commercially available from Dupont Sabanci Polyester GmbH, Hamm, DE and sold under the trade marks Comforel® T-287, Comforel® supreme and others. In EP 0 203 469 B1 a Cohesion measurement method for measuring the cohesion in (N) of a filling material is introduced. A low cohesion value is an indication of that the fibre clusters can move freely in relation to each other and is thus an indication of that the fibre clusters are indeed discrete elements. Further a low cohesion value indicates that the fibre clusters have a good refluffability and are useful for filling into pillows and other articles of bedding. Fibre balls of other designs are also available on the market. EP 0 932 717 B1 describes another type of discrete fibre clusters in the form of fluffy distinct fibre clusters resembling down. It will be appreciated that many different types of discrete fibre clusters can be utilized in the present invention.

Temperature stabilizing substances are substances that have the capability of absorbing heat (or desorbing heat) without a temperature increase and can thus serve as a temperature buffer. Well known examples of such substances are the phase change materials that undergo a phase change, e.g. a change from a solid state to a liquid state under absorption of heat, and plastic crystals such as 2,2-dimethyl-1,3-propanediol (DMP) and 2-hydroxymethyl-2-methyl-1,3-propanediol (HMP). When plastic crystals absorb heat, the molecular structure is temporarily modified without changing the phase of the material. In filling materials intended for contact with the human body the phase change materials preferably undergo a change from solid to liquid state at a temperature being below the temperature (37° C.) of the human body but above the ambient temperature (typically 20° C.). Examples of suitable phase change materials can be found in table 1, below:

TABLE 1

Examples of phase change materials

| Substance | Number of carbon atoms | Melting point ° C. |
|---|---|---|
| n-Heptadecane | 17 | 22.0 |
| n-Octadecane | 18 | 28.2 |
| n-Nonadecane | 19 | 32.1 |
| n-Eicosane | 20 | 36.8 |

The choice of phase change materials is made according to the desired function and other materials and mixtures of several phase change materials can also be utilized. Since the phase change material undergoes a phase change from solid state to liquid state it is preferably microencapsulated, i.e. contained in a plurality of microcapsules each having a shell being physically and thermally stable and encapsulating the phase change material so that it, when in the liquid state, does not leak from the fibre filling material. The size of the microcapsules is preferably about 1-2000 micrometers, still more preferably about 1-50 micrometers. Microcapsules larger than about 2000 micrometers are not very well suited since they may cause a grainy feeling in the filling material.

In many cases it is preferable to provide a binder for fixing the temperature stabilizing substance to the fibre clusters. The binder provides the necessary strength so that the filling material could be washed and handled without loss of temperature stabilizing substance. The binder, which could be a curable polymer, such as an acrylic polymer, could be mixed with the temperature stabilizing substance prior to the application to the fibre clusters or could be applied in a subsequent step as will be explained below. Examples of useful binders include, but is not limited to, polyurethane, nitride rubber, chloroprene rubber, polyvinyl alcohol, ethylene/vinyl acetate copolymer and acrylic binders. In addition, as will be described later, siliconizing agents have also been demonstrated to function as binders in the present invention.

The temperature stabilizing substance, possibly in a mixture with a binder, could be dispersed or dissolved in a solvent. The solvent reduces the viscosity of the mixture applied to the fibre clusters and improves the penetration of the temperature stabilizing substance into the fibre clusters. Thus it is possible to make some of the temperature stabilizing substance stick to the interior of the fibre cluster. The solvent also makes it easier to control the amount of temperature stabilizing substance that is applied to the fibre clusters.

The individual fibre clusters should not be entirely filled with the temperature stabilizing substance. The fibre cluster could often be said to be more or less spherical or bean shaped. A sphere having the same diameter as the fibre cluster has a certain volume. If this volume would be entirely filled with temperature stabilizing substance, and binder, if any, the fibre cluster would be filled with temperature stabilizing substance to 100%. Consequently, if each of the individual fibre clusters of the filling material were filled with temperature stabilizing substance, the filling material would have an amount of applied temperature stabilizing substance and binder of 100%. To avoid a harsh feeling and retain the soft and resilient characteristics of the individual fibre clusters the application of temperature stabilizing substance, and binder, should be made such that the fibre clusters are only partially filled with the temperature stabilizing substance. Thus the temperature stabilizing substance should be applied to the individual fibre clusters partially such that the fibre clusters of the filling material on average contain maximum 10% of the amount of temperature stabilizing substance and any binder that would correspond to an amount of 100% as defined above. For example if the fibre clusters are spherical and have a diameter of 7.5 mm their individual volume is 2.2E-7 $m^3$. If the mixture of temperature stabilizing substance and binder would have a final density (after curing) of 1000 $kg/m^3$ the amount of temperature stabilizing substance and binder corresponding to 100% would be 2.2E-7 $m^3$*1000 $kg/m^3$*1000 g/kg=0.22 g per individual fibre cluster. A partial application would thus mean that each fibre cluster, on average, would contain maximum 10%*0.22 g=0.022 g of temperature stabilizing substance and binder.

Figure 2:
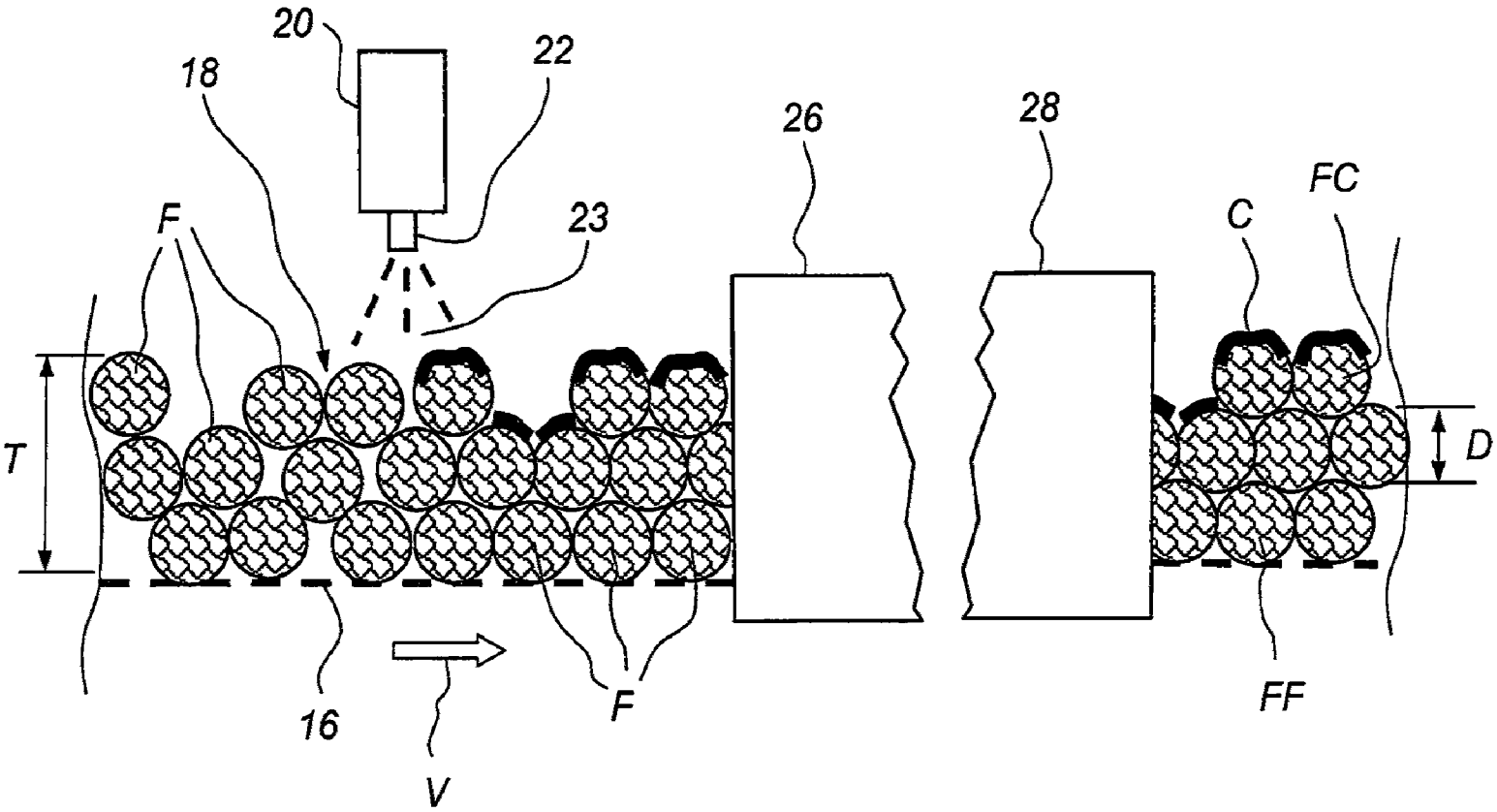
FIG. 2 is a schematic side view and shows a layer of fibre clusters during the application of a temperature stabilizing substance.

FIG. 1 illustrates a device 1 for manufacturing a filling material according to the invention. A storage bin 2 contains a bulk of discrete fibre clusters. The fibre clusters are, in the embodiment described with reference to FIGS. 1-5, provided in the form of fibre balls that are made according to the method described in the above mentioned EP 0 203 469 B1. The fibre balls are blown by a fan 4 via a duct 6 from the bin 2 to a distribution station 8. In the distribution station 8 the fibre balls are first collected in a dosing trough 10. The dosing through 10 doses a suitable flow of fibre balls into a chute 12 having a fibre ball slit 14. The fibre balls leave the slit 14 to fall on top of a moving, perforated, endless belt 16 and to form a layer 18 of fibre balls on that belt 16. The belt 16 transports the fibre balls to an application station 20. The application station 20 is provided with nozzles 22 and sprays, in a spraying zone 23 which is best shown in FIG. 2, a mixture of a binder, a solvent, such as water, and a microencapsulated phase change material onto the layer 18 of fibre balls. The belt 16 then transports the layer 18 into a curing station 24. The curing station 24 has a first section 26, in which drying takes places, and a second section 28, in which the actual curing takes place. In the first section 26 the solvent is evaporated from the mixture at a rather low temperature, such as 80° C., by a warm flow of air. In the second section 28 the binder is cured at a higher temperature, such as 110° C., by a warm flow of air to fix the microencapsulated phase change materials to the fibre balls. Preferably a hot air flow is provided by heating a circulating air flow with the help of a heating element located above the belt 16 followed by forcing the heated air vertically onto and through the layer 18 and through the perforated belt 16. After the curing station 24 the layer of fibre balls is sucked from the belt 16 into a mixer 30 which is followed by a collecting apparatus 32, which will be described in more detail below.

FIG. 2 is a schematic drawing that shows, in more detail, the plurality of discrete fibre balls, denoted with F in FIG. 2, forming the layer 18 on the perforated, endless belt 16, moving in a direction V. As can be seen from FIG. 2 the average thickness T of the layer 18 corresponds to about three fibre balls F, i.e. the thickness T corresponds to about three times the diameter D of an average fibre ball F. As is indicated in FIG. 2 it is not easy and neither necessary to obtain a completely even layer 18 of fibre balls F on the belt 16. In many cases a thickness T corresponding to about 2-6 fibre balls is preferred. When passing under the nozzles 22 of the application station 20 the fibre balls F are exposed to the mixture of binder, solvent and microencapsulated phase change material. As can be seen in FIG. 2 the mixture will predominantly attach to the upper fibre balls whereas the fibre balls being in contact with the belt 16 will receive little or nothing of the mixture. Further it can also be seen that the upper fibre balls will receive most of the mixture on their respective upper surface, i.e. the surface facing the nozzles 22. After the application the fibre balls F are moved into the first section 26 for evaporating any solvent and then into the second section 28 for curing the binder. The layer 18 leaving the second section 28 will thus comprise some fibre balls FF, i.e. those located close to the belt 16, with little or no microencapsulated phase change material, and some fibre balls FC, i.e. those that are close to the upper part of the layer 18, having a coating C of binder and microencapsulated phase change material on their respective upper surface.

Figure 3:
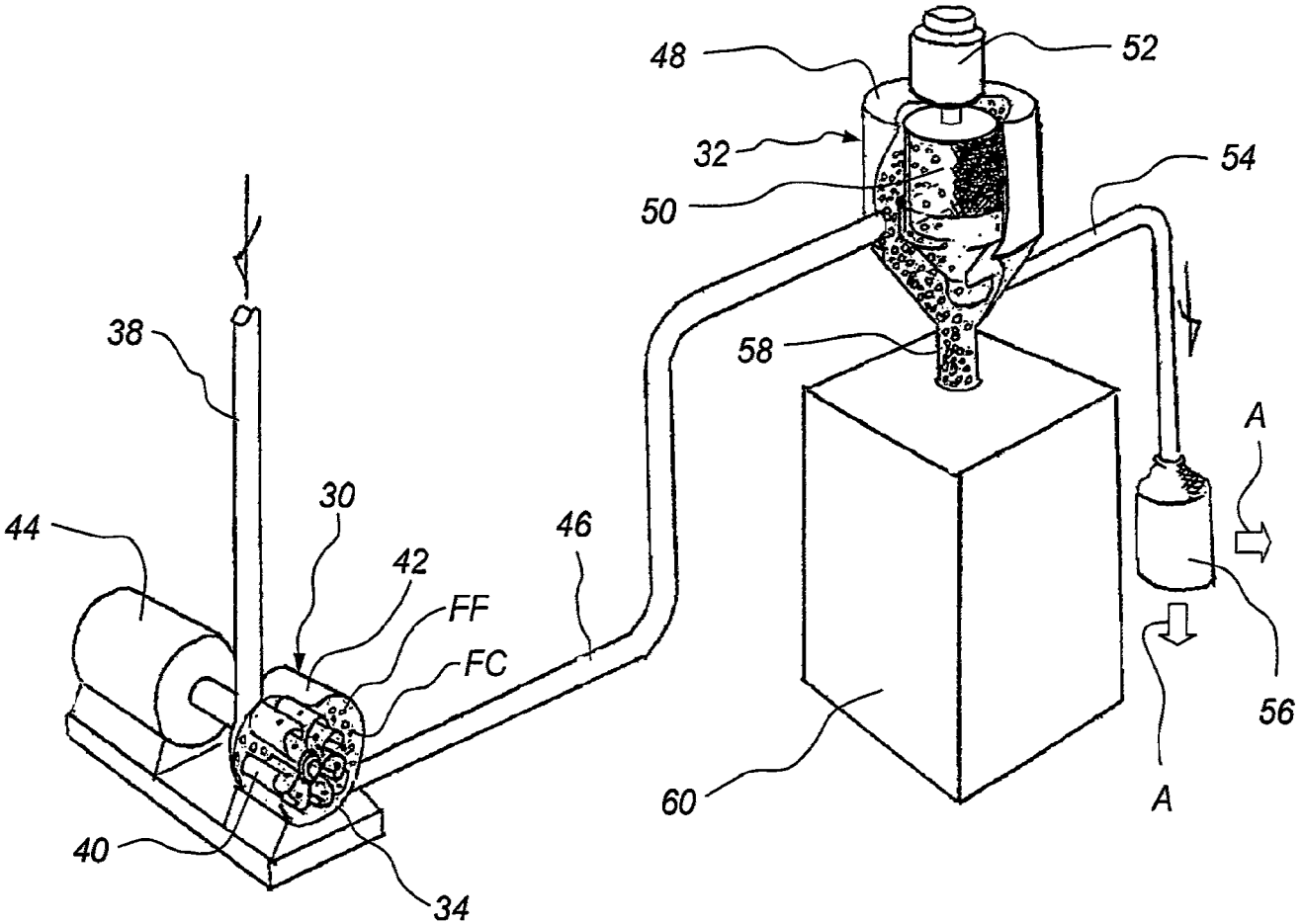
FIG. 3 is a schematic perspective view and shows a mixer and a collecting apparatus.

FIG. 3 shows a mixer 30 and a collecting apparatus 32. The mixer 30 comprises a fan 34 that sucks the fibre balls FC, FF from the belt 16 via a suction nozzle 36, shown in FIG. 1, and a duct 38. The fan 34 has an impeller 40, a fan housing 42 and a motor 44 arranged to rotate the impeller 40 inside the housing 42. When being transported through the duct 38 and in particular when passing through the fan housing 42 the fibre balls FC, FF are exposed to a mixing action mixing the fibre balls FC, FF substantially completely with each other due to the exposure to turbulent air. The turbulent air will also expose the fibre balls FC, FF to some mechanical stress which will break up any attachments between fibre balls FC, FF that might have been formed during the application and curing stages and thus separate the fibre balls FC, FF from each other. During the mixing any micro-encapsulated phase change material not firmly fixed to the fibre balls FC, FF will be torn off from the fibre balls FC, FF. Thus, in addition to the mixing, the mixer 30 performs some cleaning of the fibre balls FC, FF to remove any excess microencapsulated phase change material. The fan 34 transports the mixed fibre balls to the collecting apparatus 32 via a duct 46. It will be appreciated that some further mixing of the fibre balls will occur in the duct 46 and in the collecting apparatus 32. The collecting apparatus 32 has a housing 48 inside which a rotating screen 50 is located. The screen 50, which is a steel mesh having a width of mesh of about 1-3 mm, separates the fibre balls FC, FF from the air stream as will be described below. A motor 52 is provided for rotating the screen 50 during operation. The air that has passed through the screen 50 leaves the housing 48 via a duct 54. The duct 54 discharges into a filter bag 56. The filter bag 56, which may be made of a textile filter material, catches any excess microencapsulated phase change material and binder. The cleaned air, denoted by A, leaves the filter bag 56. The fibre balls trapped on the screen 50 leaves the housing via a duct 58 and are collected as filling material in a collecting bin 60.

Figure 4:
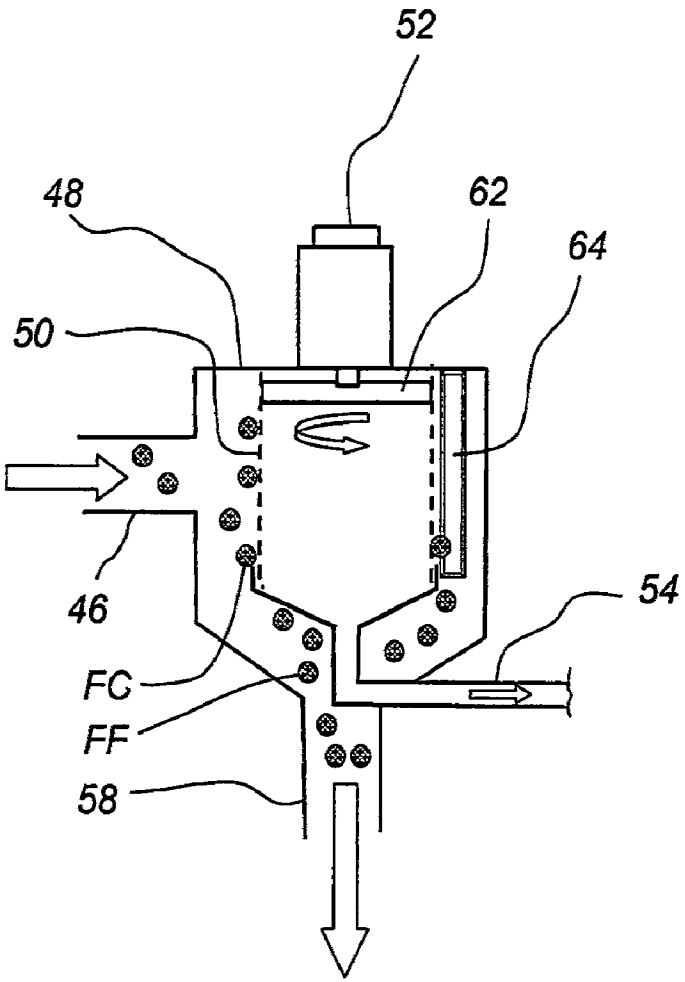
FIG. 4 is a schematic section view and shows the collecting apparatus of FIG. 3.

FIG. 4 is an enlarged section view of the housing 48. As is shown the motor 52 rotates, by means of a disc 62, the screen 50. The fibre balls FC, FF entering the housing 48 via the duct 46 are caught on the outside of the screen 50. A scraper 64 is fixed to the housing 48 adjacent to the screen 50. As the screen 50 rotates any fibre balls FC, FF stuck to the screen 50 will be removed by the scraper 64. The air, containing any excess microencapsulated phase change material, leaves the screen 50 via the duct 54 and the fibre balls FC, FF leave the housing 48 via the duct 58.

Figure 5:
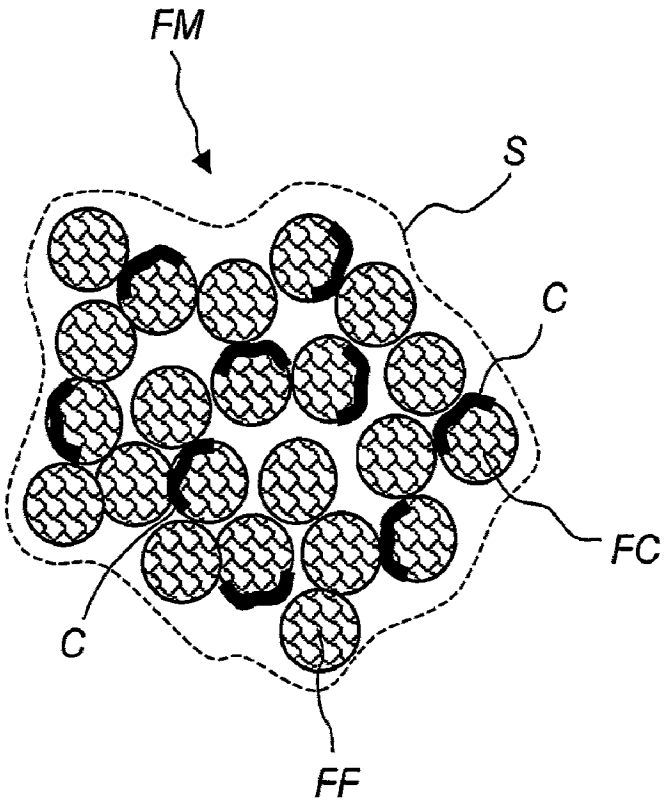
FIG. 5 is a schematic side view and shows a filling material made according to the invention.

FIG. 5 is a schematic representation of the filling material FM that is collected in the collecting bin 60. As is indicated the filling material FM contains a well mixed composition of fibre balls FC that have a coating C and fibre balls FF that do not have any coating. As is indicated in FIG. 5 the outer surface, schematically indicated by a dotted line S, of the filling material FM comprises mostly unaffected fibre ball surface, either of fibre balls FF without any coating or of fibre balls FC in which the coating C is turned inwards into the bulk of the filling material FM. Only a few coatings C are available at the surface S and thus the filling material FM will have almost the same soft feeling as if there was no microencapsulated phase change material present. Further it can be seen from FIG. 5 that the microencapsulated phase change material, although unevenly distributed throughout the individual fibre balls FC, FF, is very evenly distributed throughout the bulk of the filling material FM. This provides for a prolonged thermal stabilizing effect and increased comfort.

Figure 6:
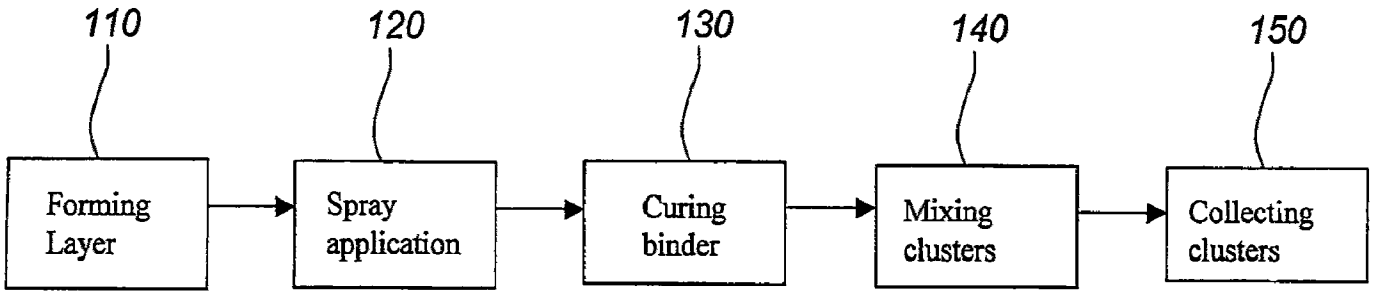
FIG. 6 is a block diagram and shows the basic steps of a first method of forming a filling material.

FIG. 6 illustrates the steps of the method performed in the device 1 described above. Discrete fibre clusters, that are made according a suitable method known in the art, e.g. according to the method described in EP 0 203 469 B1, are dispersed to form a layer of fibre clusters in a first step 110. A temperature stabilizing substance in mixture with a binder and, preferably, a solvent, is spray applied onto the fibre clusters in a second step 120. In a third step 130 any solvent is evaporated and the binder is cured to fix the temperature stabilizing substance to the fibre clusters. In a fourth step 140 the fibre clusters are mixed with each other, preferably by exposing them to a turbulent gas stream. In a fifth step 150 the discrete fibre clusters are collected and brought together to form the filling material according to the invention.

Figure 7:
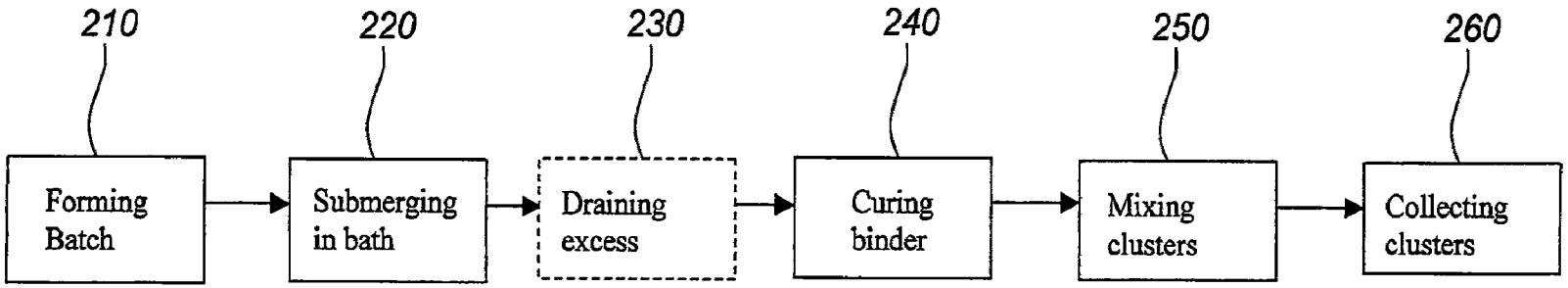
FIG. 7 is a block diagram and shows the basic steps of a second method of forming a filling material.

FIG. 7 illustrates the steps of a method according to a second embodiment of the invention. Fibre clusters, that are made according a suitable method known in the art, e.g. according to the method described in EP 0 203 469 B1, are compounded to form a batch of fibre clusters in a first step 210. The batch of fibre clusters are then submerged into a bath containing a mixture of a temperature stabilizing substance, a binder and a solvent in a second step 220. In an optional third step 230, which may often be omitted, the excess of the mixture is allowed to drain from the fibre clusters. In a fourth step 240 the solvent is evaporated and the binder is cured to fix the temperature stabilizing substance to the fibre clusters. In a fifth step 250 the fibre clusters are mixed with each other, preferably by exposing them to a turbulent gas stream. In a sixth step 260 the discrete fibre clusters are collected and brought together to form the filling material according to the invention.

Figure 8:
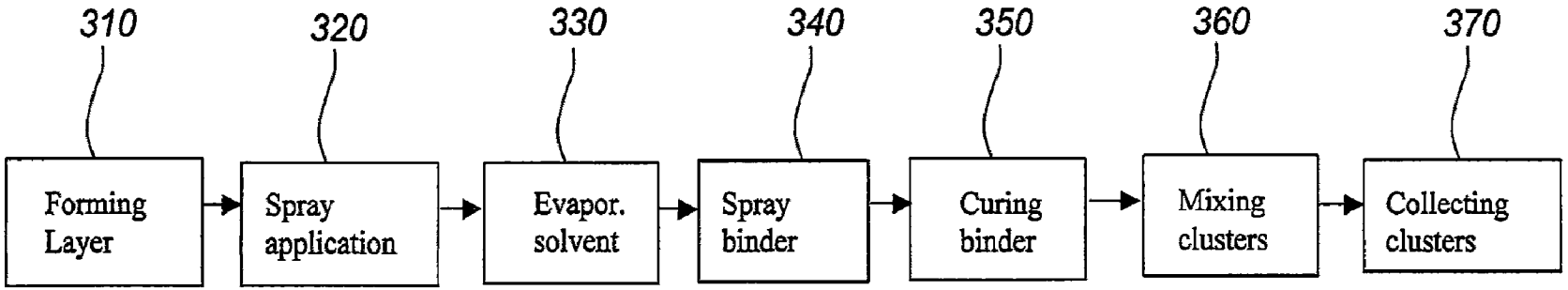
FIG. 8 is a block diagram and shows the basic steps of a third method of forming a filling material.

FIG. 8 illustrates the steps of a method according to a third embodiment of the invention. Fibre clusters, that are made according a suitable method known in the art, e.g. according to the method described in EP 0 203 469 B1, are dispersed to form a layer of fibre clusters in a first step 310. A mixture of temperature stabilizing substance and a solvent is sprayed on the layer of fibre clusters in a second step 320. In a third step 330 the layer of fibre clusters is dried to evaporate the solvent. In a fourth step 340 a binder is sprayed onto the fibre clusters. In a fifth step 350 the binder is cured to fix the temperature stabilizing substance to the fibre clusters. In a sixth step 360 the fibre clusters are mixed with each other, preferably by exposing them to a turbulent gas stream. In a seventh step 370 the discrete fibre clusters are collected and brought together to form the filling material according to the invention.

Figure 9:
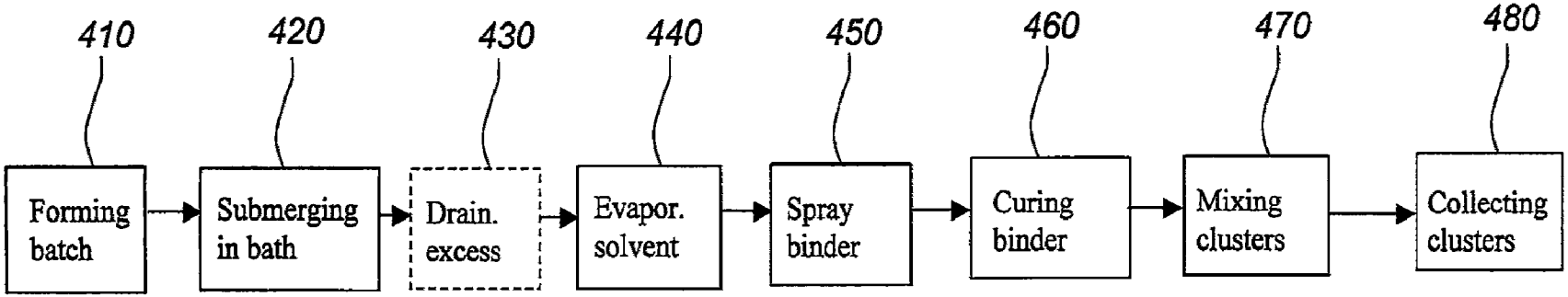
FIG. 9 is a block diagram and shows the basic steps of a fourth method of forming a filling material.

FIG. 9 illustrates the steps of a method according to a fourth embodiment of the invention. Fibre clusters, that are made according a suitable method known in the art, e.g. according to the method described in EP 0 203 469 B1, are compounded to form a batch of fibre clusters in a first step 410. The batch of fibre clusters are then submerged into a bath containing a mixture of a temperature stabilizing substance and a solvent in a second step 420. In an optional third step 430, which may often be omitted, the excess of the mixture is allowed to drain from the fibre clusters. In a fourth step 440 the solvent is evaporated. In a fifth step 450 a binder is sprayed onto the fibre clusters. In a sixth step 460 the binder is cured to fix the temperature stabilizing substance to the fibre clusters. In a seventh step 470 the fibre clusters are mixed with each other, preferably by exposing them to a turbulent gas stream. In an eighth step 480 the discrete fibre clusters are collected and brought together to form the filling material according to the invention.

Example 1

In example 1a filling material was prepared using the method described with reference to FIG. 6. Fibre clusters in the form of fibre balls of the type Comforel® T-287 available from Dupont Sabanci Polyester GmbH, Hamm, DE were used in all examples 1-4 and also in the Comparative example. 1 g of Comforel® T-287 contains about 250 individual fibre balls (each with a weight of about 0.004 g). Totally 100 g of fibre balls were dispersed on a table to form a layer with a thickness corresponding to the diameter of about two fibre balls.

A mixture was prepared based on the following components:

PMCD 32 which is a 40% dispersion of microencapsulated phase change material (m-PCM) available from Mikiriken Kogyo Co., Wakayamashi Sakaedani 13-1, 640-8441, JP. The microcapsules of this material have a size of about 1-20 micrometers, about 90% of the microcapsules have a size of 1-10 micrometers. The dispersion contains about 40 weight % m-PCM of which 75 weight % is the actual phase change material (PCM) being a mixture of n-nonadecane and n-eicosane (the remaining 25 weight % of the m-PCM is the microcapsule material).

Rikensol A-605, which is an acrylic acid ester copolymer binder in a 40% emulsion and is also available from Mikiriken Kogyo Co.

Water as a solvent.

120 g of PMCD 32 (corresponding to about 48 g of m-PCM), 50 g of Rikensol A-605 (corresponding to about 20 g of acrylic binder) and 160 g of water were compounded to form a mixture. The mixture was sprayed onto the layer of fibre balls. The fibre balls were then exposed to a temperature of 60° C. during 20 min to provide drying and curing of the binder. The fibre balls were then sucked through a mixer in the form of an ejector in which the fibre balls were substantially completely mixed with each other by means of a turbulent air stream and were finally collected on a static screen to form a filling material. A closer examination revealed that most of the individual fibre balls of the filling material had a coating of m-PCM and binder located at part of their respective surface. The m-PCM was thus unevenly distributed throughout the respective individual fibre ball. The collected filling material had, however, an even distribution of the m-PCM.

Of the totally applied 48 g of m-PCM about 44.5 g of m-PCM was fixed to the filling material. Additionally about 18.5 g of the acrylic binder was attached to the filling material. The final filling material thus had a total weight of: 100 g of fibre balls+44.5 g of m-PCM+18.5 g of acrylic binder=163 g. Thus the total content of phase change material (PCM) and binder in the filling material was (44.5 g+18.5 g)/163 g=38.6 weight %. The final filling material had a concentration of the actual phase change material (PCM) corresponding to 44.5 g*0.75/163 g=20.5 weight %. The original 100 g of Comforel® T-287 contained about 25000 individual fibre clusters. The amount of m-PCM and binder would correspond to, on average: 44.5 g m-PCM+18.5 g binder=63 g of m-PCM and binder. This value divided by 25000 individual fibre clusters gives an average amount of 0.0025 g of m-PCM and binder per individual fibre cluster.

The fibre balls had an average diameter of about 7.5 mm and thus enclosed a volume of about 2.2E-7 $m^3$ each. The cured mixture of binder and m-PCM had a density of about 1030 $kg/m^3$. Thus each fibre ball could, on average, contain maximum (=100% of the enclosed volume) 2.2E-7 $m^3$*1030 $kg/m^3$*1000 g/kg=0.23 g of m-PCM and binder. The fibre balls of Example 1 were only partially applied with m-PCM and binder and each fibre ball contained, on average, as calculated above, about 0.0025 g of binder and m-PCM corresponding to about 0.0025 g/0.23 g*100%=1.1% of the maximum amount.

A cohesion measurement was made according to the description that was first presented in EP 0 203 469 B1 (description also included below). The filling material produced in example 1 had a cohesion value of 9.1 N. The untreated filling material of the type Comforel® T-287 obtained, in a comparative measurement, a cohesion value of 5.2 N. Thus the addition of the m-PCM and binder caused a moderate increase in the cohesion value which means that the filling material produced according to example 1 still has a good refluffability and is suitable for filling into a pillow, quilt, garment or similar article.

Example 2

In example 2a filling material was prepared using the method described with reference to example 1 above but with a lower amount of m-PCM added.

Totally 100 g of fibre balls (Comforel® T-287) were dispersed on a table to form a layer with a thickness corresponding to the diameter of about two fibre balls.

30 g of PMCD 32 (corresponding to about 12 g of m-PCM), 12.5 g of Rikensol A-605 (corresponding to about 5 g of acrylic binder) and 160 g of water were compounded to form a mixture. The mixture was sprayed onto the layer of fibre balls. The fibre balls were then exposed to a temperature of 60° C. during 20 min to provide drying and curing of the binder. The fibre balls were then sucked through a mixer in the form of an ejector in which the fibre balls were mixed with each other by means of a turbulent air stream and were finally collected on a static screen to form a filling material. The filling material had almost the same handfeel as a filling material made up of untreated fibre balls. A closer examination revealed that most of the fibre balls had a coating of m-PCM and binder located at part of their respective surface. The m-PCM was thus unevenly distributed throughout the respective individual fibre ball. The collected filling material had, however, an even distribution of the m-PCM.

Of the totally applied 12 g of m-PCM about 11.5 g of m-PCM was fixed to the filling material. Additionally about 4.75 g of the acrylic binder was attached to the filling material. The final filling material thus had a total weight of: 100 g of fibre balls+11.5 g of m-PCM+4.75 g of acrylic binder=116.25 g. Thus the total content of phase change material (PCM) and binder in the filling material was (11.5 g+4.75 g)/116.25 g=14.0 weight %. The final filling material had a concentration of the actual phase change material (PCM) corresponding to 11.5 g*0.75/116.25 g=7.4 weight %. The original 100 g of Comforel® T-287 contained about 25000 individual fibre clusters. The total amount of m-PCM and binder corresponds to: 11.5 g m-PCM+4.75 g binder=16.25 g of m-PCM and binder. This value divided by 25000 individual fibre clusters gives an average amount of 0.00065 g of m-PCM and binder per individual fibre cluster.

As calculated above in example 1 each fibre ball could, on average, contain maximum about 0.23 g of m-PCM and binder. The fibre balls of Example 2 were only partially applied with m-PCM and binder and each fibre ball contained, on average, as calculated above, about 0.00065 g of binder and m-PCM corresponding to about 0.00065 g/0.23 g*100%=0.28% of the maximum amount.

A cohesion measurement was made according to the description that was first presented in EP 0 203 469 E1 (description also included below). The filling material produced in example 2 had a cohesion value of 6.2 N. The untreated filling material of the type Comforel® T-287 obtained, as mentioned above in example 1, a cohesion value of 5.2 N. Thus the addition of the m-PCM and binder caused a very slight increase in the cohesion value which means that the filling material produced according to example 2 still has a good refluffability and is suitable for filling into a pillow, quilt or similar article.

Example 3

In example 3a filling material was prepared using the method described with reference to example 1 above but with a lower amount of m-PCM and with a siliconizing agent as a binder instead of an acrylic polymer. The siliconizing agent was a silicone finish emulsion containing aminofunctionalpolydimethylsiloxane (6% silicone).

Totally 100 g of fibre balls (Comforel® T-287) were dispersed on a table to form a layer with a thickness corresponding to the diameter of about two fibre balls.

60 g of PMCD 32 (corresponding to about 24 g of m-PCM), 100 g of the siliconizing agent emulsion (corresponding to 6 g of silicone) and 60 g of water were compounded to form a mixture. The mixture was sprayed onto the layer of fibre balls. The fibre balls were then dried at 80° C. during about 20 min, after which time the water had evaporated. The fibre balls were then cured at 150° C. during about 5 min. The fibre balls were then sucked through a mixer in the form of an ejector in which the fibre balls were mixed with each other by means of a turbulent air stream and were finally collected on a static screen to form a filling material. The filling material had almost the same handfeel as a filling material made up of untreated fibre balls. A closer examination revealed that most of the fibre balls had a coating of m-PCM and binder located at part of their respective surface. The m-PCM was thus unevenly distributed throughout the respective individual fibre ball. The collected filling material had, however, an even distribution of the m-PCM.

Of the totally applied 24 g of m-PCM about 22.5 g of m-PCM was fixed to the filling material. Additionally about 5.5 g of the silicone finish was attached to the filling material. The final filling material thus had a total weight of: 100 g of fibre balls+22.5 g of m-PCM+5.5 g of silicone finish=128 g. Thus the total content of phase change material (PCM) and binder in the filling material was (22.5 g+5.5 g)/128 g=21.9 weight %. The final filling material had a concentration of the actual phase change material (PCM) corresponding to 22.5 g*0.75/128 g=13 weight %. The original 100 g of Comforel® T-287 contained about 25000 individual fibre clusters. The total amount of m-PCM and binder corresponds to: 22.5 g m-PCM+5.5 g binder=28 g of m-PCM and binder. This value divided by 25000 individual fibre clusters gives an average amount of 0.0011 g of m-PCM and binder per individual fibre cluster.

As calculated above in example 1 each fibre ball could, on average, contain maximum about 0.23 g of m-PCM and binder. The fibre balls of Example 3 were only partially applied with m-PCM and binder and each fibre ball contained, on average, as calculated above, about 0.0011 g of binder and m-PCM corresponding to about 0.0011/0.23*100%=0.48% of the maximum amount.

A cohesion measurement was made according to the description that was first presented in EP 0 203 469 B1 (description also included below). The filling material produced in example 3 had a cohesion value of 5.0 N. The untreated filling material of the type Comforel® T-287 obtained, as mentioned above in example 1, a cohesion value of 5.2 N. Thus the addition of the m-PCM and silicone finish binder actually provided an improvement in the cohesion value which means that the filling material produced according to example 3 has a good refluffability and is suitable for filling into a pillow, quilt or similar article.

Example 4

In example 4 a filling material was prepared using the method described with reference to FIG. 9. Totally 100 g of fibre balls of the type Comforel® T-287 were submerged in a bath containing a mixture of 60 g PMCD 32 (corresponding to about 24 g of m-PCM) and 160 g of water. The fibre balls were then dried at 80° C. for 15 minutes to evaporate the water. 100 g of a siliconizing agent in the form of a silicone finish emulsion containing aminofunctionalpolydimethylsiloxane (6% emulsion, thus corresponding to 6 g of silicone) was then, with the intention of working as a binder, sprayed onto the fibre balls which were then cured at 150° C. for about 5 minutes. The fibre balls were mixed and a filling material was collected in accordance with the procedure described for Example 1. The filling material had almost the same handfeel as a filling material made up of untreated fibre balls.

Of the totally applied 24 g of m-PCM about 22.5 g of m-PCM was fixed to the filling material. Additionally about 5.5 g of the silicone finish was attached to the filling material. The final filling material thus had a total weight of: 100 g of fibre balls+22.5 g of m-PCM+5.5 g of silicon finish=128 g. Thus the total content of phase change material (PCM) and binder in the filling material was (22.5 g+5.5 g)/128 g=21.9 weight %. The final filling material had a concentration of the actual phase change material (PCM) corresponding to 22.5 g*0.75/128 g=13 weight %. The original 100 g of Comforel® T-287 contained about 25000 individual fibre clusters. The total amount of m-PCM and binder corresponds to: 22.5 g m-PCM+5.5 g binder=28 g of m-PCM and binder. This value divided by 25000 individual fibre clusters gives an average amount of 0.0011 g of m-PCM and binder per individual fibre cluster.

As calculated above in example 1 each fibre ball could, on average, contain maximum about 0.23 g of m-PCM and binder. The fibre balls of Example 4 were only partially applied with m-PCM and binder and each fibre ball contained, on average, as calculated above, about 0.0011 g of binder and m-PCM corresponding to about 0.0011 g/0.23 g*100%=0.48% of the maximum amount.

A cohesion measurement was made according to the description that was first presented in EP 0 203 469 B1 (description also included below). The filling material produced in example 4 had a cohesion value of 4.3 N. The untreated filling material of the type Comforel® T-287 obtained, as mentioned above in example 1, a cohesion value of 5.2 N. Thus the addition of the m-PCM and silicone finish binder actually provided an improvement in the cohesion value which means that the filling material produced according to example 4 has a good refluffability and is suitable for filling into a pillow, quilt or similar article.

Comparative Example

A comparative example was designed to test whether a complete coating of the surface of the fibre balls would create a useful filling material. A complete coating of the surface of a web is demonstrated in EP 0 611 330 B1 and it was to be tested whether such a complete coating would be viable for fibre balls.

Totally 50 g of fibre balls (Comforel® T-287) were dispersed on a table to form a layer with a thickness corresponding to the diameter of about two fibre balls.

150 g of PMCD 32 (corresponding to about 60 g of m-PCM), 62.5 g of Rikensol A-605 (corresponding to about 25 g of acrylic binder) and 80 g of water were compounded to form a mixture. The mixture was sprayed onto the layer of fibre balls. The fibre balls were then turned around 180° and were then sprayed again with the same amount of PCM and binder. Finally the fibre balls were moved apart from each other and were, in a third step, sprayed from the sides with twice the amount of m-PCM and binder in order to coat almost the entire surface of each fibre ball. After each spraying the fibre balls were exposed to a temperature of 60° C. during 20 min to provide drying and curing of the binder. Totally, in all three sequences, 600 g of PMCD 32 and 250 g of Rikensol A-605 was applied to the 50 g of fibre balls. The fibre balls were then sucked through a mixer in the form of an ejector in which the fibre balls were mixed with each other by means of a turbulent air stream and were finally collected on a static screen to form a filling material. The filling material had a very hard and grainy feeling and completely lacked softness.

Of the totally applied 240 g of m-PCM about 98 g of m-PCM was fixed to the filling material. Of the totally applied 100 g of binder applied about 40 g was attached to the filling material. The final filling material thus had a total weight of: 50 g of fibre balls+98 g of m-PCM+40 g of binder=188 g. The final filling material had a concentration of the actual phase change material (PCM) corresponding to 98 g*0.75/188 g 39 weight %.

A cohesion measurement was made according to the description that was first presented in EP 0 203 469 B1 (description also included below). The filling material produced in the Comparative example had a cohesion value of 30.5 N. The untreated filling material of the type Comforel® T-287 obtained, as mentioned above in example 1, a cohesion value of 5.2 N. The coating of the entire surface of the fibre balls, as is done in EP 0 611 330 B1 but for a web, provides a filling material with no softness and limited refluffability. Such a filling material cannot be used for filling into a pillow, quilt or similar article.

Figure 10:
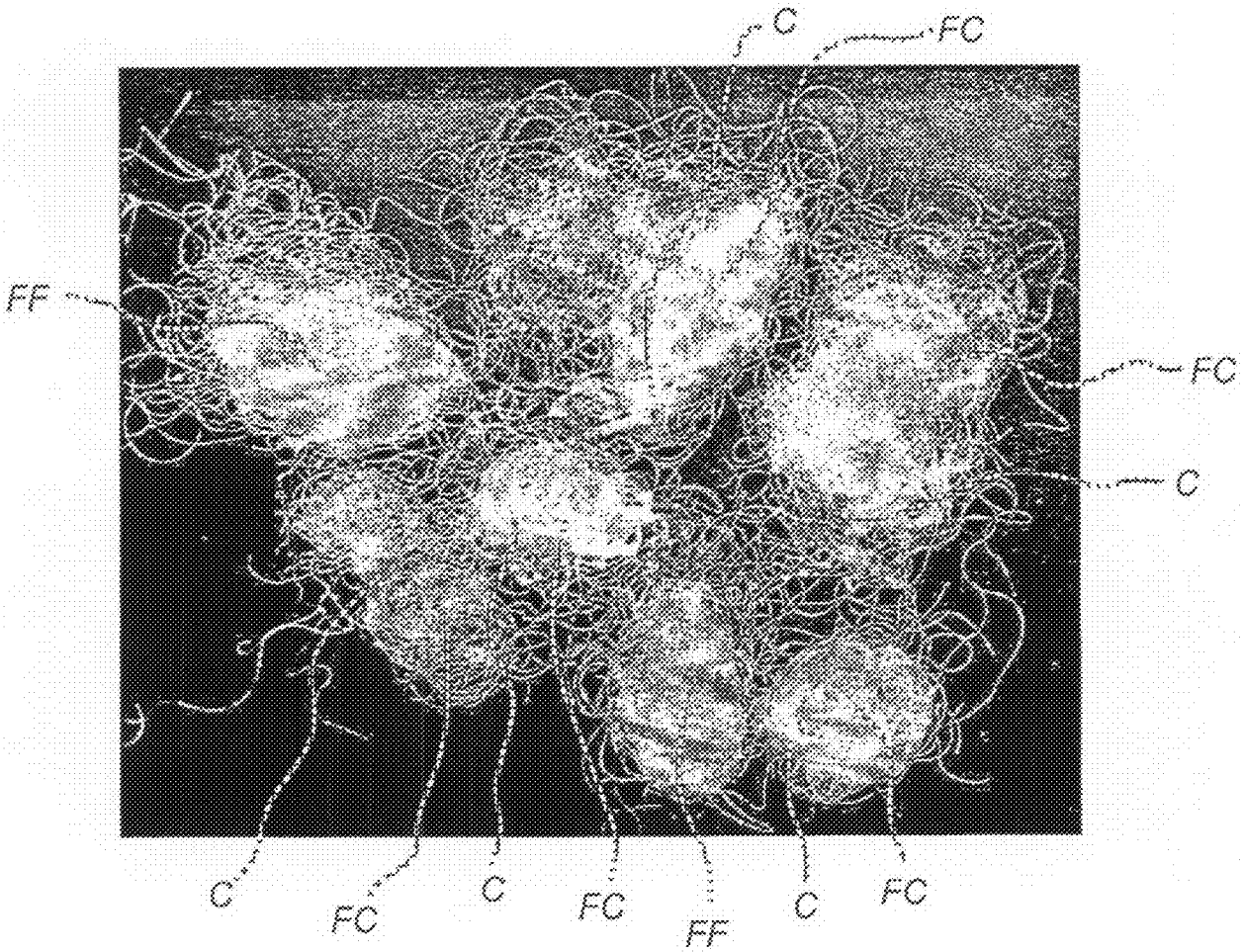
FIG. 10 is a photograph and shows fibre clusters having different types of uneven distribution of microencapsulated phase change material attached thereto.

FIG. 10 is a photograph showing some fibre balls obtained by the above described examples. FC denotes fibre balls with a rather large concentration of m-PCM, denoted by C in FIG. 10, and FF denotes fibre balls with little or no m-PCM. The exact location of the coating in the individual fibre balls depends on the application method, e.g. spraying or dipping, the type and viscosity of the binder etc. In one and the same example the individual fibre balls will also have different coating patterns.

The fibre balls are made from a slickened fibre having a quite hydrophobic surface. Thus, also in the case of dipping, the temperature stabilizing substance will, due to this hydrophobic surface of the fibres, form islands of m-PCM in the individual fibre clusters thus providing an uneven distribution also in the case of dipping.

It will be appreciated that numerous modifications of the embodiments described above are possible within the scope of the appended claims.

Thus for example other types of fibre clusters may also be used for manufacturing a filling material according to the invention. According to a preferred embodiment the fibre clusters are made from a siliconised fibre, as is described for example in EP 0 203 469 B1. Such a fibre cluster provides an extra soft feeling and excellent refluffability. A siliconised fibre is rather hydrophobic and would repel the temperature stabilizing substance to form isolated "islands" of temperature stabilizing substance in the fibre cluster. An effect of this is that the major portion of such a fibre cluster would remain unaffected by the temperature stabilizing substance and thus retain its excellent softness. Such fibre clusters provide, after the steps of mixing and collecting the fibre clusters, a filling material with a very soft feeling.

In the embodiments described with reference to FIGS. 8 and 9 a temperature stabilizing substance is applied in a step 320, 420, respectively, being separated from the step of applying the binder, which is made in step 340, 450, respectively. In those embodiments the binder is preferably a siliconizing agent, such as a polysiloxane, an amino silicone or a silicone rubber, being similar or identical to the siliconizing agents applied to staple fibres for slickening purposes. Other silicone slickening agents and also non-silicone slickening agents, such as segmented copolymers of polyalkyleneoxide and other polymers, such as polyester or polyethylene or polyalkylene polymers as is mentioned in U.S. Pat. No. 6,492,020 B1, may also be used. The application of a siliconizing agent as a binder in step 340, 450 respectively has several advantages. The siliconizing agent provides for both a binding effect, binding the temperature stabilizing substance to the fibre clusters, and a slickening effect. Since the soft feeling of the fibre clusters might get somewhat reduced during the application of the temperature stabilizing substance the latter effect is a large advantage. In addition the siliconizing agents commonly used have a low viscosity making the them particularly suitable for entering into the inside of the fibre clusters to provide a binding and slickening effect also in the interior of the individual fibre clusters.

The device 1 described above has an application station 20 having nozzles 22. It will be appreciated that in the event the fibre clusters are instead to be submerged in a mixture of temperature stabilizing substance and solvent the application station will instead include a tank containing this mixture and means for submerging the fibre clusters therein.

A device adapted to perform the methods described with reference to FIGS. 8 and 9 would preferably additionally have, placed downstream of the application station, an evaporation station, and, located downstream of the evaporation station and upstream of the curing station, a binder application station for applying a binder, such as a siliconizing agent.

The filling materials prepared according to the invention should preferably have a cohesion value of less than about 20 N, more preferably less than about 15 N and most preferably less than about 10 N, in order to provide a filling material with good refluffability and softness.

The total weight of the temperature stabilizing substance and the possible binder in the filling material of the present invention is preferably maximum about 10%, more preferably maximum about 4%, and most preferably maximum about 2%, of the total weight that the temperature stabilizing substance and the possible binder would hypothetically have if they were to entirely fill the same volume as is totally enclosed by the total number of individual discrete fibre clusters of the filling material. Thus, in the average fibre cluster, maximum about 10% of its volume should be filled with temperature stabilizing substance and binder, although the individual variations between the fibre clusters of a filling material may be very large.

The total content of temperature stabilizing substance and binder, if any, in the filling material, i.e. the fibre clusters with the temperature stabilizing substance and the binder, if any, applied thereto, is preferably maximum about 85 weight %, more preferably maximum about 70 weight % and most preferably maximum about 55 weight %, in order to provide a filling material with suitable softness and refluffability. A filling material in which the total content of temperature stabilizing substance and binder is more than 85 weight %, i.e. a filling material in which 100 g of filling material would contain more than 85 g of temperature stabilizing substance and binder and less than 15 g of fibre clusters, will have a very limited refluffability.

If it would be desirable to obtain a fibre filling material according to the invention and with a still lower cohesion value one possibility is to use, as a starting material, a fibre cluster of a type having a very low initial cohesion value, such as lower than 4 N.

Above it is described that mixing of the fibre clusters is achieved by passing them through a fan. Alternatives to a fan comprise ejectors and other devices providing a turbulent gas stream. Although it is preferred to mix the fibre clusters by exposing them to a turbulent gas stream it is also possible to mix them by means of a mechanical agitator or another mechanical device or by combinations of turbulent gas streams and mechanical means, such as static mixer elements installed in ducts through which the fibre clusters are passed.

Cohesion Measurement

The above referenced cohesion measurements were made according to the following technique, which was also described in EP 0 203 469 B1:

This test was designed to test the ability of the fibre filling material to allow a body to pass therethrough, and this does seem to correlate somewhat with refluffability in the case of fibre filling material having a spiral-crimp and of the same dimensions, especially of the fibre balls. In essence, the cohesion is the force needed to pull a vertical rectangle of metal rods up through the fibre filling material which is retained by 6 stationary metal rods closely spaced in pairs on either side of the plane of the rectangle. All the metals rods are of 4 mm diameter, and of stainless steel. The rectangle is made of rods of length 430 mm (vertical) and 160 mm (horizontal). The rectangle is attached below the traverse of the universal test control unit Instron type 5564 and the open distance between the lowest rod of the rectangle and the bottom of a plastic transparent cylinder, which has a diameter of 180 mm and a height of 340 mm, is 3 mm. (The stationary rods will later be introduced through holes in the wall of the cylinder and positioned 20 mm apart in pairs on either side of the rectangle). Before inserting these rods, however, 50 g of the fibre filling material to be tested is placed in the cylinder, and the zero point of the Instron testing unit is adjusted to compensate for the weight of the rectangle and of the fibre filling material. Prior to being filled into the cylinder the fibre filling material is conditioned at a relative humidity of 65% (+/−2%) and a temperature of 20° C. (+/−2° C.) during 24 h. The fibre filling material is compressed under a weight disc of 402 g and 175 mm diameter for 2 minutes. The 6 (stationary) rods are then introduced horizontally through the holes in the wall of the cylinder, as mentioned, 3 rods on either side of the rectangle one pair above the other, at vertical separations of 20 mm measured from centre to centre of the rods. The vertical distance between the lowest pair of rods and the cylinder bottom was 25 mm (i.e. the lowest rod of the rectangle was held about 20 mm below the lowest pair of rods in the wall of the cylinder. For ease of introducing the rods into the cylinder a vertical guide plate is used.). The weight disc is then removed. Finally, the rectangle is pulled up at a speed of 100 mm/min through the fibre filling material between the three pairs of stationary rods, as the Instron testing unit measures the build-up of the force in Newtons. The cohesion is believed to be a good measure of refluffability of comparable fibre balls from fibre filling material of spiral-crimp.

Volume Measurement

The above described measurement of the volume that is enclosed by an individual fibre cluster is conducted in the following way: A representative sample of 50 fibre clusters is taken from a fibre filling material. The 50 fibre clusters are inspected visually and are judged with regard to roundness and are separated into two groups; "round" and "non-round". All the fibre clusters that have a length to width ratio in cross-section of less than 2:1 are regarded as "round". For each of the fibre clusters in the group "round" a representative diameter is measured. In doing so the diameter of the main body of the fibre cluster is measured, i.e. any singular fibres sticking out of the main body are disregarded. For each fibre cluster in the group "round" a volume is calculated based on the measured diameter and under the assumption of spherical shape. For each of the fibre clusters in the group "non-round" a shortest dimension is measured to represent a diameter and a longest dimension is measured to represent a length. In doing so the dimensions of the main body of the fibre cluster are measured, i.e. any singular fibres sticking out of the main body are disregarded. For each fibre cluster in the group "non-round" a volume is calculated based on the measured dimensions and under the assumption of cylindrical shape, the shortest dimension measured being used as diameter and the longest dimension measured being used as length in this calculation. In the next step all volumes measured for the individual "round" and "non-round" fibre clusters are summarized and are then divided by 50 to obtain an average volume that is a representative individual volume of each of the fibre clusters of the sample.

Calculation of Amount of Temperature Stabilizing Substance and a Possible Binder A representative sample of 10 g is taken from a filling material and the number of discrete fibre clusters in the sample is counted. As alternative to actually counting the fibre clusters of 10 g of filling material, the weight, in grams, of 50 fibre clusters could be measured and could then be recalculated to the number of fibre clusters corresponding to 10 g of filling material. The density of the applied mixture of temperature stabilizing substance and a possible binder, in its cured state, is measured. Based on the representative volume of one fibre cluster, as measured above, and the density of said mixture it is calculated what weight (in grams) of the applied mixture of temperature stabilizing substance and a possible binder could hypothetically be contained in one fibre cluster if the entire representative volume of that one fibre cluster was filled with said mixture.

The weight of the same number of fibre clusters as in the sample, but prior to application of the mixture of temperature stabilizing substance and the possible binder, is measured. This weight is subtracted from the 10 g of the sample to obtain the weight (in grams) of temperature stabilizing substance and the possible binder in the sample. The thus calculated weight of temperature stabilizing substance and the possible binder in the sample is divided by the total number of fibre clusters in the sample to obtain the average weight (in grams) of temperature stabilizing substance and the possible binder in one fibre cluster of the sample.

An alternative way of analysing the amount of temperature stabilizing substance and binder, if any, in the sample of filling material is to treat the sample of filling material with a suitable solvent. The solvent is chosen such that it dissolves the temperature stabilizing substance and the binder, if any, from the fibre clusters. The thereby obtained solution, which contains the solvent, the temperature stabilizing substance and the binder, is separated from the fibre clusters. By then removing the solvent from the solution, by e.g. evaporation, the amount and density of the temperature stabilizing substance and the binder, if any, may be analysed and used in the further calculations.

Finally the average weight (in grams) of temperature stabilizing substance and the possible binder in one fibre cluster of the sample is divided by the weight (in grams) that hypothetically, as calculated above, could be contained in one fibre cluster if the entire representative volume of that one fibre cluster was filled with said mixture. Thereby the amount (in %) of the applied mixture of temperature stabilizing substance and the possible binder in the sample, in relation to what is hypothetically possible, is obtained.

The invention claimed is:

1. A filling material for filling a textile adapted to come into contact with human skin and to provide a soft feeling to the skin, comprising a plurality of discrete fiber clusters, at least some of said plurality of discrete fiber clusters including a temperature stabilizing substance partially covering the surface of each individual fiber cluster, and/or forming islands within each individual fiber cluster thereof, wherein the plurality of discrete fiber clusters of the filling material are mixed with each other providing a substantially even distribution of the temperature stabilizing substance in the filling material.

2. A filling material according to claim 1, wherein the temperature stabilizing substance comprises a phase change material and/or plastic crystals.

3. A filling material according to claim 1, wherein the discrete fibre clusters are fibre balls.

4. A filling material according to claim 1, in which the discrete fibre clusters have an average characteristic measure, such as an average diameter, of 1-15 mm.

5. A filling material according to claim 1, wherein the temperature stabilizing substance is bonded to the fibre clusters by a binder that is chosen from the group of siliconizing agents.

6. A filling material according to claim 1, in which the amount of temperature stabilizing substance and a possible binder in the filling material corresponds to maximum 10% of the weight that the temperature stabilizing substance and the possible binder would have if they were to fill the same volume as is totally enclosed by the total number of individual discrete fibre clusters of the filling material.

* * * * *

UNITED STATES PATENT AND TRADEMARK OFFICE

CERTIFICATE OF CORRECTION

PATENT NO. : 8,137,808 B2
APPLICATION NO. : 11/631309
DATED : March 20, 2012
INVENTOR(S) : Jurgen Musch It is certified that error appears in the above-identified patent and that said Letters Patent is hereby corrected as shown below:

On the Title Page, at item (54), and at Column 1, lines 1-2, correct the title to read as follows:

--FILLING MATERIAL AND A METHOD AND A DEVICE FOR MANUFACTURING IT--.

On the Title Page, at item (73), Assignee, change "CARL FREUDENBERG AG" to:

--CARL FREUDENBERG KG--.

Signed and Sealed this
Nineteenth Day of June, 2012

David J. Kappos

David J. Kappos
*Director of the United States Patent and Trademark Office*